US007763834B2

(12) United States Patent
Teneze et al.

(10) Patent No.: US 7,763,834 B2
(45) Date of Patent: Jul. 27, 2010

(54) FLYING OBJECT FOR OBSERVING THE GROUND

(75) Inventors: Bernard Teneze, Trouy (FR); Michel Blin, Bourges (FR)

(73) Assignee: MBDA France, Paris (FR)

( * ) Notice: Subject to any disclaimer, the term of this patent is extended or adjusted under 35 U.S.C. 154(b) by 361 days.

(21) Appl. No.: 10/586,599

(22) PCT Filed: May 12, 2005

(86) PCT No.: PCT/FR2005/001186

§ 371 (c)(1),
(2), (4) Date: Jul. 20, 2006

(87) PCT Pub. No.: WO2006/000662

PCT Pub. Date: Jan. 5, 2006

(65) Prior Publication Data

US 2008/0245256 A1 Oct. 9, 2008

(30) Foreign Application Priority Data

May 27, 2004 (FR) ..... 04 05719

(51) Int. Cl.
*F41G 9/00* (2006.01)
*F42B 15/00* (2006.01)

(52) U.S. Cl. ..... 244/3.22; 244/3.17

(58) Field of Classification Search ..... 244/23 B, 244/12.3, 1 TD, 3.22, 3.24, 3.12, 23 A, 23 R, 244/171.1, 190, 73 C, 73 B, 74, 14, 3.15, 244/3.16, 3.17, 3.21; 102/374, 504; 60/224, 60/225, 229; 89/1.11
See application file for complete search history.

(56) References Cited

U.S. PATENT DOCUMENTS 2,898,856 A * 8/1959 Lightbody et al. ..... 102/377

(Continued)

FOREIGN PATENT DOCUMENTS

DE 3313648 10/1984

(Continued)

OTHER PUBLICATIONS

PCT International Search Report dated Oct. 6, 2005.

*Primary Examiner*—Tien Dinh
*Assistant Examiner*—Richard R Green
(74) *Attorney, Agent, or Firm*—Dickson Wright PLLC

(57) ABSTRACT

A flying object includes a lift and displacement motor which has a combustible propelling charge and direct thrust flight control and can ensure the lift and displacement of the flying object in an observation position for which the flying object is at least approximately vertical with the rear part thereof oriented downwards; an attitude motor with a combustible propelling charge and conventional thrust vector control; and an observation unit which is arranged in the rear part of the flying object.

14 Claims, 3 Drawing Sheets

U.S. PATENT DOCUMENTS

| | | | | | |
|---|---|---|---|---|---|
| 3,112,669 | A | * | 12/1963 | Damblanc | 89/1.13 |
| 3,185,096 | A | * | 5/1965 | Dandelin | 102/377 |
| 3,233,548 | A | * | 2/1966 | Saxton | 244/3.12 |
| 3,806,064 | A | * | 4/1974 | Parilla | 244/3.22 |
| 3,979,086 | A | | 9/1976 | MacAdam | |
| 4,562,980 | A | * | 1/1986 | Deans et al. | 244/3.22 |
| H236 | H | * | 3/1987 | Maykut | 244/3.22 |
| 4,913,379 | A | * | 4/1990 | Kubota et al. | 244/52 |
| 5,181,673 | A | * | 1/1993 | Hubricht et al. | 244/3.12 |
| 5,405,103 | A | * | 4/1995 | Girardeau et al. | 244/3.22 |
| 5,456,425 | A | * | 10/1995 | Morris et al. | 244/3.22 |
| 5,620,152 | A | * | 4/1997 | Sargent | 244/3.12 |
| 6,705,573 | B2 | * | 3/2004 | McDonnell | 244/170 |

FOREIGN PATENT DOCUMENTS

| | | |
|---|---|---|
| FR | 2558585 | 7/1985 |
| GB | 1284487 | 8/1972 |

* cited by examiner

FLYING OBJECT FOR OBSERVING THE GROUND

FIELD OF THE INVENTION

The present invention relates to a flying object for observing the ground, that can be used to attack terrestrial targets, in particular ones which are concealed by an obstacle.

BACKGROUND OF RELATED ART

Flying objects for observing the ground that generally take the form of a small pilotless aircraft (drone) are already known. Such flying objects are relatively vulnerable and are easy targets for enemy antiaerial defense means and, moreover, they must be in continual motion and cannot therefore stop to carefully observe a particular zone of the terrain. To avoid the latter drawback, the production of drones in the form of small helicopters has already been contemplated. However, these are also very vulnerable.

Additionally, regardless of the form of these known drones, aircraft or helicopter, they are able to serve only for reconnaissance and not for attacking enemy targets that they may discover and observe.

SUMMARY OF THE INVENTION

The object of the present invention is to remedy these drawbacks.

To this end, according to the invention, a flying object for observing the ground, comprising an elongate body, is noteworthy:

in that it comprises:

- a lift and displacement motor, of the type with combustible propelling charge, associated with first exhaust nozzles directed towards the rear of said elongate body and distributed laterally about the latter, producing lateral maneuvering forces whose lines of action pass through the center of gravity of said flying object, said forces being able to ensure the lift and the displacements of said flying object in an observation position for which said object is at least approximately vertical with the rear end of said flying object directed downwards;
- an attitude motor, of the type with combustible propelling charge, associated with second exhaust nozzles, directed towards the rear of said elongate body and distributed laterally around the latter, producing lateral maneuvering forces able to maintain said flying object in said at least approximately vertical observation position; and
- picture taking means, disposed at the rear of said elongate body and able to observe said ground when said flying object is in said at least approximately vertical observation position; and in that said lift and displacement motor and said attitude motor are disposed on either side of said center of gravity of the flying object and in that, during the combustion of the respective propelling charges of these latter two motors, the position of said center of gravity remains at least approximately fixed.

Thus, in the flying object in accordance with the invention, the lift and the displacement, on the one hand, and the attitude, on the other hand, are controlled by two distinct motors dedicated solely to their respective function, thereby allowing great accuracy in the following of the trajectory of the flying object and in the vertical presentation of the latter with respect to the ground, thereby rendering it less vulnerable to the terrestrial antiaerial defenses of an enemy and allowing it to observe, with care and while idling, any suspicious zone of the terrain, for example concealed behind an obstacle.

Moreover, it will be pointed out that, on account of the quasi-coincidence of the center of gravity, of the point of steering of the lift and displacement motor (steering by force) and of the aerodynamic center, the latter motor, as well as the transverse aerodynamic forces—including wind gusts—have only little influence on the attitude.

Advantageously, said lift and displacement motor exhibits a larger mass than said attitude motor and is closer to the center of gravity of the flying object than the latter. Said attitude motor may be disposed at the rear of said elongate body, while said lift and displacement motor is disposed just in front of the center of gravity of said flying object.

To allow said picture taking means to produce sharp images of the ground observed, it is necessary to control the roll of the flying object according to the present invention. Since the lift and displacement motor carries out functions that are less sensitive than those carried out by the attitude motor, it is preferable for it to be this former motor which controls the roll of said flying object.

Preferably, the flying object according to the invention is launched, in a known manner in respect of certain attack missiles, by a launch and control post comprising a propulsion or ejection system which is specific thereto and which is not carried by said flying object. Thus, it is possible to eliminate from said flying object according to the invention the rear motor generally responsible for launch and to dispose, in place of said rear motor, said picture taking means.

After launch thereof, said flying object can fly in an autonomous manner, for example to carry out a preset flight plan. As a variant, the flying object in accordance with the present invention can comprise means of linking with said launch and control post.

Thus, it may possibly receive information from said post or have the latter do calculations, this making it possible to lighten said flying object. Preferably, said means of linking comprise, in a known manner, at least one optical fiber, unreelable from said flying object. Thus, the information flowing between the flying object and said post cannot be jammed.

In particular, to facilitate its displacements above the terrain observed, the flying object according to the invention can comprise an additional picture taking means disposed at the front of said elongate body.

In an advantageous embodiment, the flying object in accordance with the present invention carries a warhead charge and it comprises means of propulsion and means of guidance allowing it to attack, preferably without flipping over, that is to say, via its rear part, a target detected by said rear picture taking means. The attack of said target can be controlled, either from the launch and control post to which the images of the target are transmitted by said means of linking, or automatically by a target reconnaissance device carried by said flying object.

Said means of propulsion and said means of guidance of said object in the direction of the target detected can be independent of said lift and displacement motor and of said attitude motor. In this case, said means of propulsion and said means of guidance of said object in the direction of said target can consist of an additional motor disposed at the front of said elongate body. Such an additional motor can be of the type with combustible propelling charge, possibly provided with an orientable nozzle. It is preferable for said additional motor to be stationed behind a droppable hood of said flying object.

As a variant, said means of propulsion and said means of guidance of said object in the direction of the target detected are respectively formed by said lift and displacement motor and by said attitude motor, associated respectively with third and fourth nozzles, directed towards the front of said elongate body and distributed laterally around the latter. Said first and second nozzles can be orientable and form said third and fourth nozzles when they are oriented towards the front of said elongate body. As a variant, said third and fourth nozzles can be fixed and supplied with combustion gas by said lift and displacement motor and by said attitude motor, by virtue of supply switching systems disposed at the respective outlets of said lift and displacement motor and of said attitude motor and making it possible to supply either said first and second nozzles, or said third and fourth nozzles.

BREIF DESCRIPTION OF THE DRAWINGS

The figures of the appended drawing will elucidate the manner in which the invention may be embodied. In these figures, identical references designate similar elements.

DETAILED DESCRIPTION OF THE INVENTION

Figures 1, 2, 3, 4:
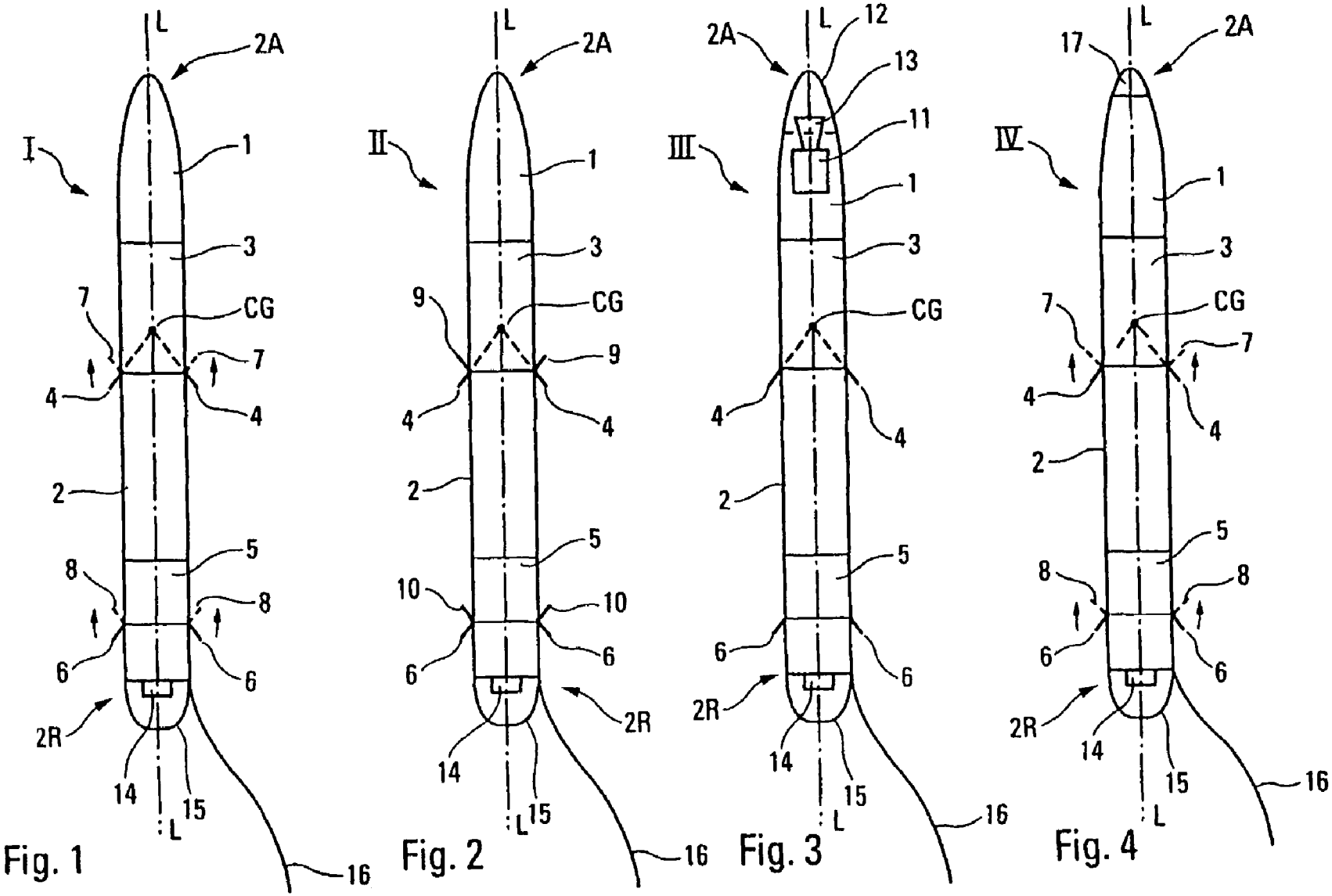
FIGS. 1 to 4 show diagrammatically four embodiments of the flying object in accordance with the present invention.

In FIGS. 1 to 4, four exemplary embodiments I to IV of the flying object 1 in accordance with the present invention have been represented diagrammatically.

Each of these exemplary embodiments comprises an elongate body 2, for example cylindrical, of longitudinal axis L-L, exhibiting a front 2A and a rear 2R and encompassing:

a lift and displacement motor 3, of the type with combustible propelling charge, comprising exhaust nozzles 4 for the combustion gases, for example 4 in number, equidistributed laterally around said elongate body 2 and directed towards the rear 2R of the latter. The axes of the nozzles 4 pass through the center of gravity CG of said flying object 1, so that the motor 3 produces lateral maneuvering forces whose lines of action pass likewise through said center of gravity. These maneuvering forces are controllable, in a known manner, for example by moveable jet deflectors, that can take at least two positions, preferably three, able to at least partially shut off or to completely clear said nozzles 4. Thus, as is known for certain missiles, said flying object 1 is steerable "in terms of force" by the motor 3; and an attitude motor 5, likewise of the type with combustible propelling charge, comprising exhaust nozzles 6 for the combustion gases, remote from the center of gravity CG and being for example likewise 4 in number, equidistributed laterally around said elongate body 2 and directed towards the rear 2R of the latter. The attitude motor 5 therefore produces lateral maneuvering forces controllable, in a known manner, for example by moveable jet deflectors, likewise with at least two positions, preferably three, able to at least partially shut off or to completely clear said nozzles 6. The nozzles 6 being remote from the center of gravity CG, the attitude motor 5 carries out steering, "in terms of torque" on the flying object 1.

The motors 3 and 5 are disposed on either side of the center of gravity CG of the flying object and the motor 3 is heavier than the motor 5 and closer to the center of gravity CG than the latter. The combustion of the combustible propelling charges of these motors is adjusted so that, when the motors 3 and 5 are operating, the position of the center -of gravity CG remains at least substantially fixed.

In the exemplary embodiments I (FIG. 1) and IV (FIG. 4) of the flying object 1, the nozzles 4 and 6 are orientable, as is illustrated by the arrows, and may take respectively positions 7 and 8 directed towards the front 2A of the elongate body 2, as indicated by dashes.

In the exemplary embodiment II (FIG. 2), the lift and displacement motor 3 comprises, in addition to the nozzles 4, fixed nozzles 9, equidistributed laterally around said elongate body 2 and directed towards the front 2A of the latter. By virtue of known controllable switching means, the lift and displacement motor 3 can supply combustion gas either to the nozzles 4 or to the fixed nozzles 9. Likewise, the attitude motor 5 comprises, in addition to the nozzles 6, fixed nozzles 10, equidistributed laterally around the elongate body 2 and directed towards the front 2A of the latter. By virtue of known controllable switching means, the attitude motor 5 can supply combustion gas either to the nozzles 6 or to the fixed nozzles 10.

In the exemplary embodiment III (FIG. 3), the flying object 1 comprises an additional motor 11, for example, of the type with combustible propelling charge, disposed at the front 2A of the elongate body 2, for example behind a droppable hood 12 of the latter. The additional motor 11 is provided with an axial nozzle 13, preferably orientable, directed to the front 2A side of the elongate body 2.

In all the exemplary embodiments I to IV, the flying object 1 comprises, at the rear 2R of the elongate body 2, a camera 14 protected by a hood 15, transparent to the radiations to which the camera 14 is sensitive. Moreover, all these exemplary embodiments I to IV comprise, in a manner known for missiles, a warhead charge, an electronic flight control system (not represented) and an unreelable reserve (not represented) of an optical fiber 16.

In the exemplary embodiment IV (FIG. 4), the flying object comprises an additional camera 17 the front 2A of the elongate body 2.

The flying object 1, regardless of its embodiment I to IV, is able to be launched by a launch and control post 18, which is provided with a system for propelling said flying object 1 remaining in its launch tube 19, after launch. Moreover, the flying object 1 is linked to said launch and control post 18 by way of the optical fiber 16 of the unreelable reserve. By virtue of such an optical fiber 16, the flying object 1 and the post 18 can exchange information, possibly obviating the need for the presence of a computer on board the flying object 1.

Figure 5:
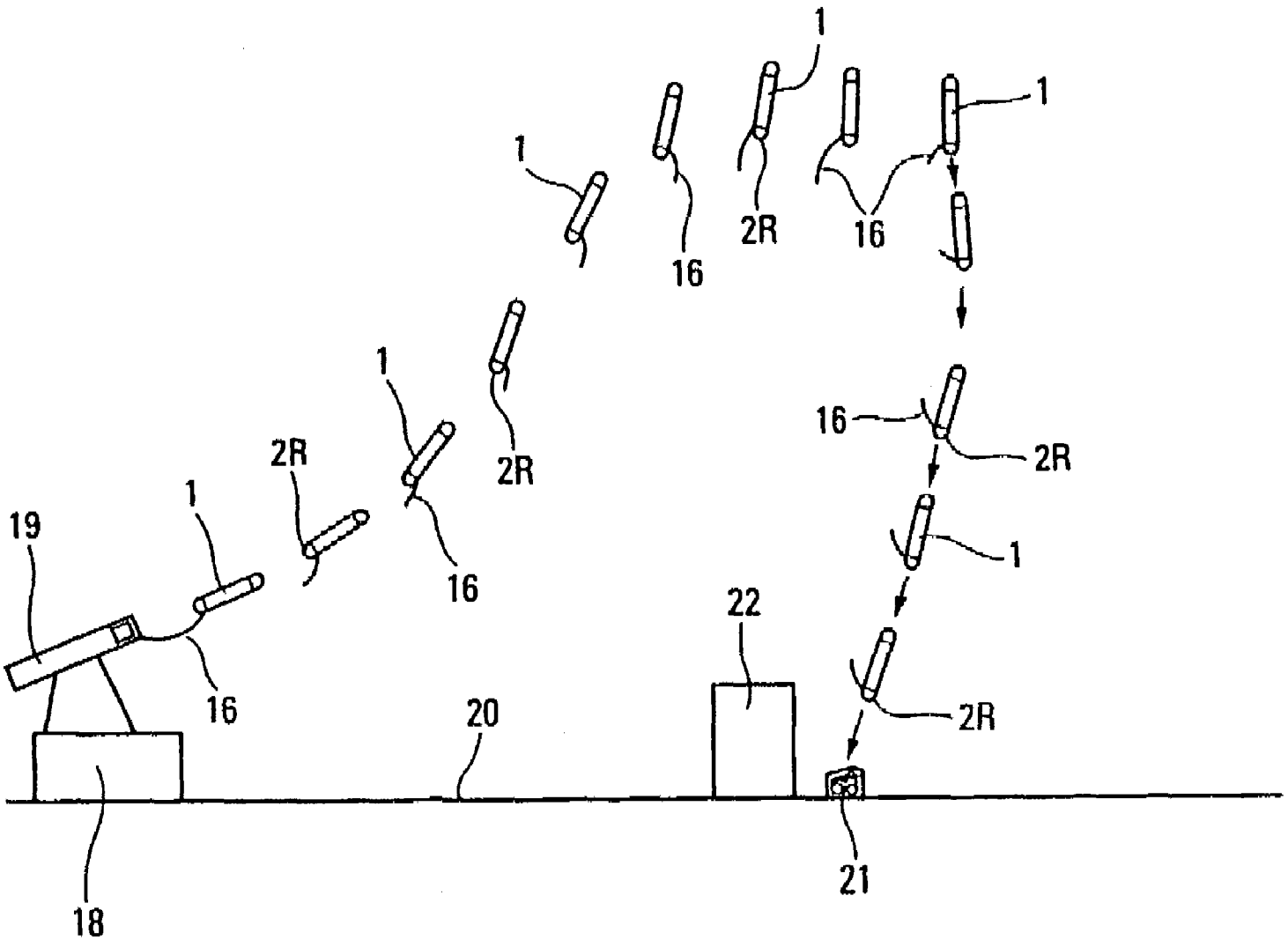
FIGS. 5 and 6 illustrate diagrammatically two examples of flight of said flying object.

After launch by the post 18, the flying object 1 ignites its motors 3 and 5 which propel it and steer it by virtue of their nozzles 4 and 6 and make it take a vertical position, with the rear 2R and hence its camera 14 directed towards the ground 20. In this vertical position, the flying object 1 can move laterally, while being stabilized in terms of attitude and roll, in such a way that its camera 14 observes the ground under it. When said camera 14 detects a target 21, for example concealed to the firing post 18 by an obstacle 22, the flying object 1 can be propelled and directed onto this target 21, via the rear 2R of the elongate body 2, either by the nozzles 4 and 6 in positions 7 and 8 (exemplary embodiments I and IV), or by the fixed nozzles 9 and 10 (exemplary embodiment II), or else by the additional motor 11 and the nozzle 13 (exemplary embodiment III). Such a reconnaissance and attack process, which corresponds more particularly to a high-arc destructive shot fired at a concealed target whose existence was probable, is illustrated by FIG. 5.

Figure 6:
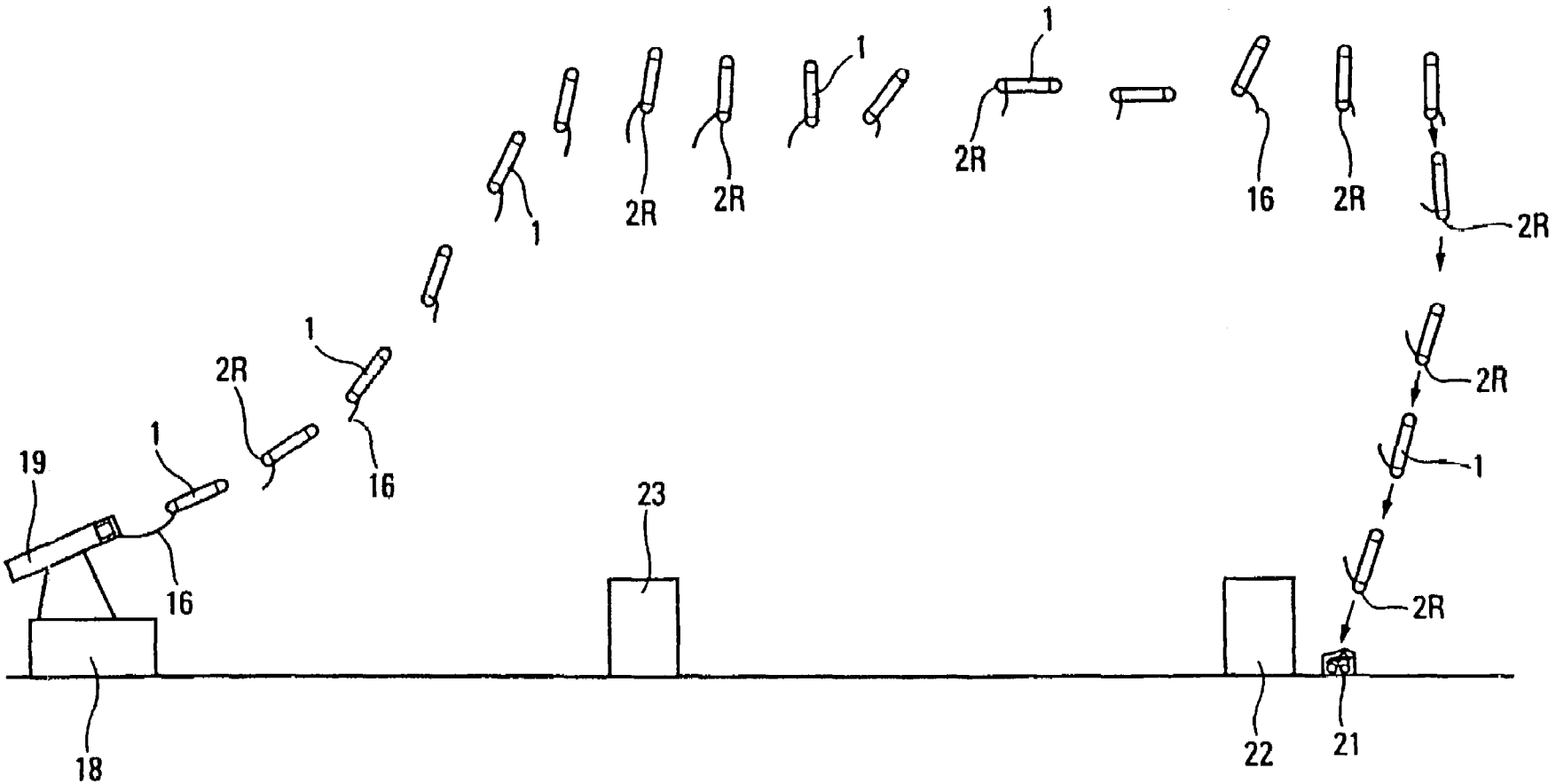

If, as is illustrated by FIG. 6, the flying object 1 has to maraud in search of a target 21 to attack, it is advantageous that, above target-free terrains, the motors 3 and 5 cause the flying object 1 to swing into the horizontal position and propel it in this position until it swings back into the vertical observation position to examine a zone liable to comprise a target 22. In this phase of horizontal flight, the additional camera 17 is particularly useful.

As will be readily understood, the present invention is particularly useful for observing successively zones of terrains concealed to the firing post by obstacles 22, 23 and liable to contain targets 21 that are required to be destroyed.

The invention claimed is:

1. A flying object for observing the ground, comprising:

an elongate body;

a lift and displacement motor, with combustible propelling charge, producing lateral maneuvering forces whose lines of action pass through the center of gravity of said flying object;

an attitude motor, with combustible propelling charge, producing lateral maneuvering forces, said lift and displacement motor and said attitude motor being disposed on either side of said center of gravity of the flying object and the combustion of the respective propelling charges of these latter two motors being adjusted so that, when the latter two motors are operating, the position of said center of gravity remains at least approximately fixed, and a picture taking unit mounted on board said flying object, wherein:

said lift and displacement motor is able to ensure the lift and the displacements of said flying object in an observation position for which said object is at least approximately vertical with the rear end of said flying object directed downwards;

said attitude motor is structured to maintain said flying object in said at least approximately vertical observation position; and said picture taking unit is disposed at a rear part of said flying object to observe said ground when said flying object is in said at least approximately vertical observation position.

2. The flying object as claimed in claim 1, wherein said lift and displacement motor exhibits a larger mass than said attitude motor and is closer to the center of gravity of the flying object than said attitude motor.

3. The flying object as claimed in claim 1, wherein said attitude motor is disposed at the rear of said elongate body, while said lift and displacement motor is disposed just in front of the center of gravity of said flying object.

4. The flying object as claimed in claim 1, wherein said flying object is controlled in roll by the lift and displacement motor.

5. The flying object as claimed in claim 1, wherein said flying object is launched by a launch and control post comprising a propulsion or ejection system which is specific thereto and which is not carried by said flying object.

6. The flying object as claimed in claim 5, wherein said flying object comprises a linking unit to link with said launch and control post.

7. The flying object as claimed in claim 6, wherein said linking unit comprises at least one optical fiber.

8. The flying object as claimed in claim 1, wherein said flying object comprises an additional picture taking unit disposed at the front of said elongate body.

9. The flying object as claimed in claim 1, wherein said flying object carries a warhead charge and further comprises a propulsion unit and a guidance unit allowing said flying object to attack, via the rear part of said elongate body, a target detected by said picture taking unit disposed at the rear of said elongate body; and said propulsion unit and said guidance unit of said object in the direction of said target are independent of said lift and displacement motor and of said attitude motor.

10. The flying object as claimed in claim 9, wherein said propulsion unit and said guidance unit of said object in the direction of said target form an additional motor disposed at the front of said elongate body.

11. The flying object as claimed in claim 10, wherein said additional motor is disposed behind a droppable hood.

12. The flying object as claimed in claim 1, wherein said flying object carries a warhead charge and further comprises a propulsion unit and a guidance unit allowing said flying object to attack, via the rear part of said elongate body, a target detected by said picture taking unit disposed at the rear of said elongate body;

said lift and displacement motor is associated with first exhaust nozzles directed towards the rear of said elongate body and distributed laterally about the latter;

said attitude motor is associated with second exhaust nozzles directed towards the rear of said elongate body and distributed laterally about the latter; and said propulsion unit and said guidance unit of said object in the direction of said target are respectively formed by said lift and displacement motor and by said attitude motor, associated respectively with third and fourth nozzles, directed towards the front of said elongate body and distributed laterally around the elongate body.

13. The flying object as claimed in claim 12, wherein said first and second nozzles are orientable and form said third and fourth nozzles when they are oriented towards the front of said elongate body.

14. The flying object as claimed in claim 12, wherein said third and fourth nozzles are fixed and are respectively supplied with combustion gas by said lift and displacement motor and by said attitude motor.

* * * * *